US005524763A

United States Patent [19]

Wile

[11] Patent Number: 5,524,763

[45] Date of Patent: Jun. 11, 1996

[54] DISPENSING SYSTEM FOR T-SHIRT TYPE BAGS

[75] Inventor: Richard M. Wile, Medfield, Mass.

[73] Assignee: BPI Packaging Technologies, Inc., North Dighton, Mass.

[21] Appl. No.: 431,101

[22] Filed: Apr. 28, 1995

[51] Int. Cl.[6] ..... B65D 73/00

[52] U.S. Cl. ..... 206/554; 206/494; 221/63

[58] Field of Search ..... 221/26, 33, 45, 221/46, 63; 206/554, 494, 495, 493, 806

[56] References Cited

U.S. PATENT DOCUMENTS

| | | | |
|---|---|---|---|
| 2,899,161 | 8/1959 | Bayard . | |
| 3,184,055 | 5/1965 | Davis et al. . | |
| 3,317,037 | 5/1967 | Russell . | |
| 3,338,398 | 8/1967 | Altman, Jr. | 206/554 X |
| 3,747,298 | 7/1973 | Lieberman . | |
| 3,896,966 | 7/1975 | Canno | 206/554 X |
| 4,062,170 | 12/1977 | Orem . | |
| 4,106,734 | 8/1978 | Walitalo . | |
| 4,199,122 | 4/1980 | Christie . | |
| 4,480,750 | 11/1984 | Dancy . | |
| 4,487,388 | 12/1984 | Provan . | |
| 4,493,419 | 1/1985 | Prader et al. . | |
| 4,529,090 | 7/1985 | Pilon . | |
| 4,676,378 | 6/1987 | Baxley et al. . | |
| 4,877,473 | 10/1989 | Snowdon et al. . | |
| 5,332,097 | 7/1994 | Wile | 206/554 |

*Primary Examiner*—Jacob K. Ackun
*Attorney, Agent, or Firm*—Henry D. Pahl, Jr.

[57] ABSTRACT

In the dispensing system disclosed herein, an aligned stack of T-shirt type bags are assembled within a disposable tubular cartridge with the loop handles and a significant portion of the bottoms of the bags extending beyond the ends of the tubular cartridge. The central portions of the bag mouths are releasably attached to an adjacent portion of the cartridge and a rack is provided for supporting the cartridge essentially horizontally with the handles and the bottom portions of the bags hanging freely therefrom. Accordingly, the top bag in the stack can be removed by grasping the exposed bottom portion and pulling the remainder through the tubular cartridge, tearing the mouth of the bag free from the attachment.

12 Claims, 4 Drawing Sheets

DISPENSING SYSTEM FOR T-SHIRT TYPE BAGS

BACKGROUND OF THE INVENTION

The present invention relates to a system for dispensing T-shirt type bags and, more particularly, to such a system which may be mounted under a counter and which allows successive bags to be easily removed from a supply of such bags.

A variety of systems have been devised heretofore for dispensing and loading merchandise and produce bags, particularly bags of the so-called T-shirt type. Examples of such dispensing systems are, for example, disclosed in U.S. Pat. Nos.: 2,899,161; 3,184,055; 3,317,037; 3,747,298; 4,062,170; 4,106,734; 4,199,122; 4,480,750; 4,529,090; 4,676,378; 4,877,473; and 5,332,097.

As is understood by those skilled in the art, T-shirt type bags present some particular problems in handling and dispensing since the loop handles extending from either side of the openable mouth of the bag may tend to slide or jumble unless constrained. This problem is particularly evident if the bags are to be mounted on a rack having projecting arms which are intended to extend through apertures in the loop handles. Systems for dealing with that particular problem are disclosed, for example, in U.S. Pat. Nos. 4,676,378 and 4,877,473.

Among the several objects of the present invention may be noted the provision of a novel system for dispensing T-shirt type bags; the provision of such a system which facilitates the removal of individual bags from a stack of such bags; the provision of such a system which does not require rack arms to be inserted through apertures in the bag handles; the provision of such a system which does not require constraining of the bag handles; the provision of such a system which can be readily mounted under a merchandiser's checkout counter and which occupies minimal space; and the provision of such a system which is highly reliable and which is of relatively simple and inexpensive construction. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
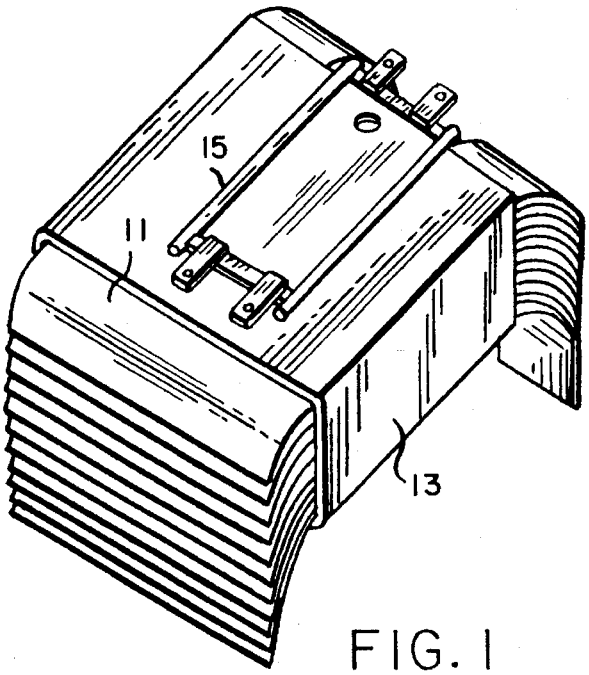
FIG. 1 is a perspective view of a bag dispensing system in accordance with the present invention.

Referring now to FIG. 1, the dispensing system illustrated there includes an aligned stack of T-shirt type bags 11 assembled in a disposable tubular cartridge 13 which is, in turn, supported in a horizontal orientation by means of a wire rack 15. Wire rack 15 is adapted to be mounted under a merchandiser's checkout counter.

Figure 2:
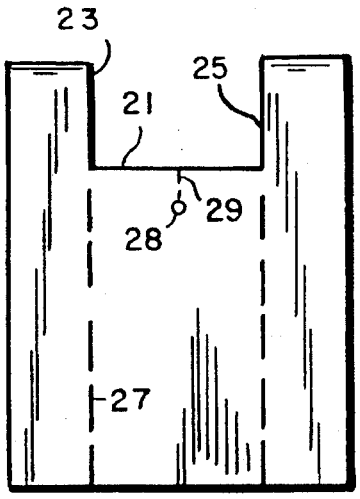
FIG. 2 illustrates the construction of bags adapted for use in the system of FIG. 1.

The bags 11 are of essentially conventional construction. Typically such bags are constructed by forming a gusseted tube of thermoplastic film and then heat sealing the tube at predetermined intervals to form individual elements which then become separate bags. The tube is then cut at regular intervals to separate the individual elements which comprise front and back panels joined at the top as well as at the bottom and on the side. With reference to FIG. 2, the top end of each element is then cut out to form an operable mouth 21 with loop handles 23 and 25 on either side of the mouth. For attachment of the bags to the cartridge 13, an aperture 28 is provided near each mouth edge. Preferably, a perforated tear line 29 is provided between the aperture and the edge. A J-shaped cut might also be employed. The mouth is openable allowing merchandise to be placed in the space between the front and back panels which form the body of the bag. In FIG. 2, the gussets are indicated by reference character 27. In the description herein, the terms top and bottom are used in reference to the bags 11 with regard to its normal upright orientation, e.g., when loaded with merchandise, although it will be understood from the following description that the bags are held in a draped horizontal configuration prior to dispensing in accordance with the practice of the present invention.

Figure 3:
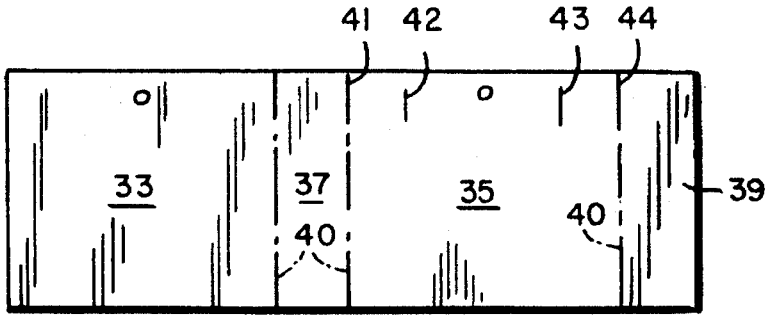
FIG. 3 illustrates a cartridge blank useful in forming a cartridge employed in the system of FIG. 1.
Figure 4:
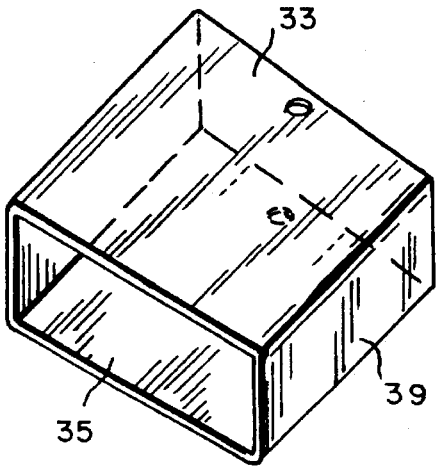
FIG. 4 illustrates the blank of FIG. 3 folded into the cartridge shape.

The cartridge 13 is disposable and is preferably formed from a cardboard blank as illustrated in FIG. 3. The cartridge blank provides top and bottom panels, designated by reference characters 33 and 35 respectively, joined by side panels 37 and 39. The panels are separated by score lines 40 so that the cartridge may be easily folded into a tubular form of rectangular cross-section as illustrated in FIG. 4. The cartridge may be held in tubular form by tape or by a conventional tab and slot arrangement (not shown), glue or any other conventional attaching means. If desired, an overlapping side panel may be employed to facilitate assembly. The bottom panel 35 is provided, along one free edge of the panel, with longitudinal slits 41–44 with two slits on either side being separated by a width slightly larger than the width of the bag handles 23 and 25, respectively. Accordingly, the handles can cause these sections to bend or fold downward slightly as described in greater detail hereinafter.

Figure 5:
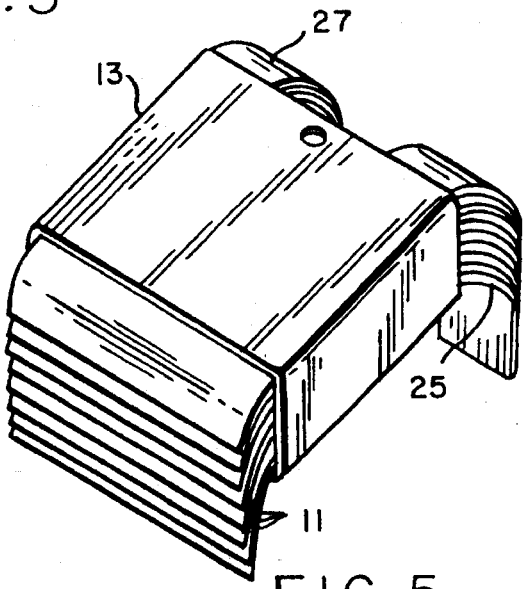
FIG. 5 illustrates the cartridge of FIG. 4 filled with bags.

FIG. 5 illustrates the cartridge assembled and containing an aligned stack of T-shirt type bags 11 and oriented in the same fashion as when presented for dispensing. As illustrated, the bottom portions of the front and back panels of the individual bags 11 hang freely down from one end of the tubular cartridge while the handles 23 and 25 extend from and hang freely down from the other end of the tubular cartridge. In the preferred embodiment, the portion between the slits 41 and 42 and the portion between the slits 43 and 44 are bent down as illustrated.

Figure 6:
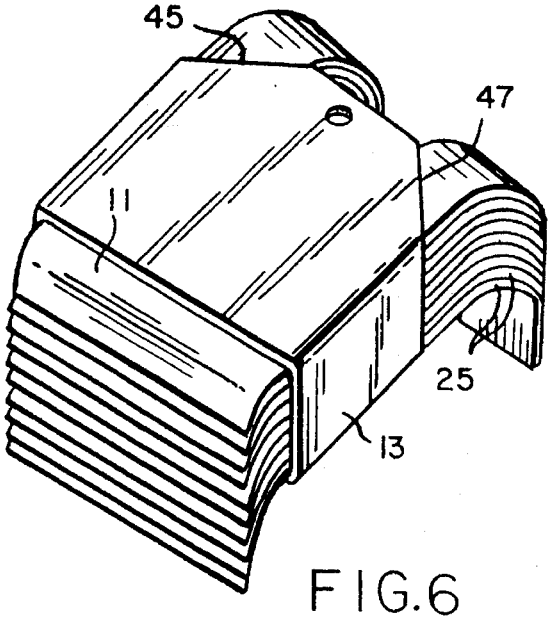
FIG. 6 illustrates an alternate form of cartridge filled with bags.

An alternative or additional feature to providing slits in the bottom panel of the cartridge, is to bevel the inner ends of the top and bottom panels as illustrated at reference characters 45 and 47 in FIG. 6 so that the handles are allowed to flop more freely than would be the case with straight rigid top and bottom panels.

Figure 7:
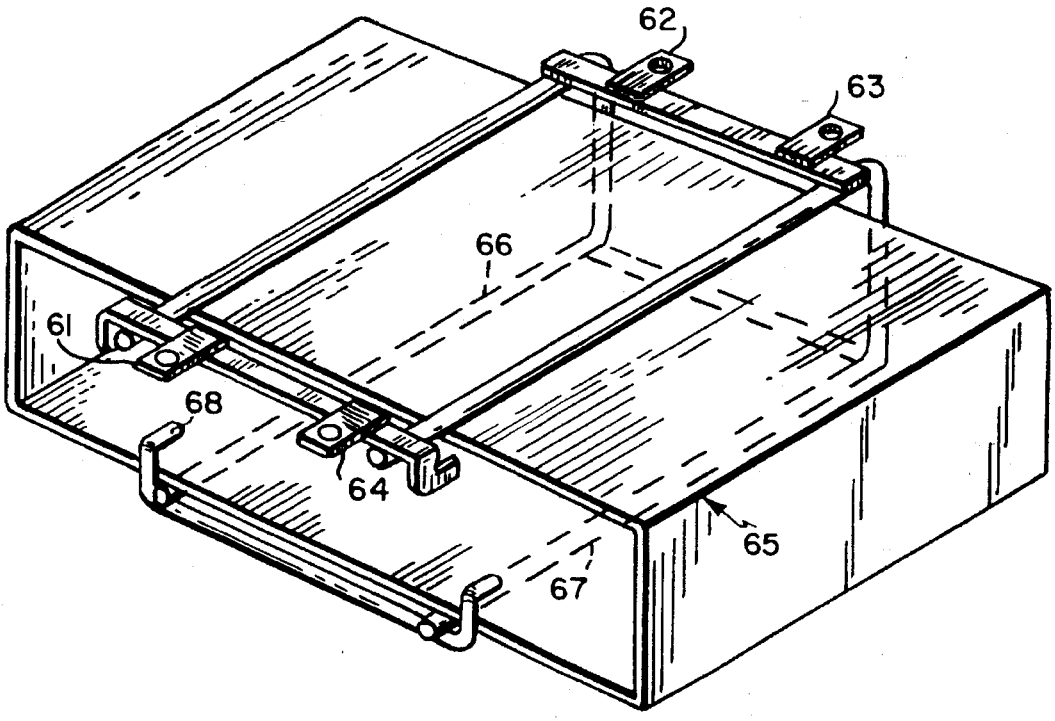
FIG. 7 illustrates a rack employed in the system of FIG. 1.

The construction of the wire rack 15 can best be seen in FIG. 7 where the rack is shown with an empty cartridge 13 for purposes of illustration. The wire rack is designed to be mountable underneath a merchandiser's checkout counter by means of apertured tabs 61–64 and provides, below the counter, an arm 65 made up of two parallel rods 66 and 67 which extends forward and terminates in a hook 68 which can engage and retain the bottom panel 35 of the cartridge 13, i.e., unless it is deliberately lifted up to be disengaged from the hook. As will be understood by those skilled in the art, a flat metal arm terminating in an appropriate hook shape might also be used.

As may be seen from FIG. 1, the width of the rack arm 65 is less than the width of the bag mouth 21 between the handles 23 and 25 so that the handles can pass on either side of the rack as illustrated and then hang down freely as described herein before.

Figure 8:
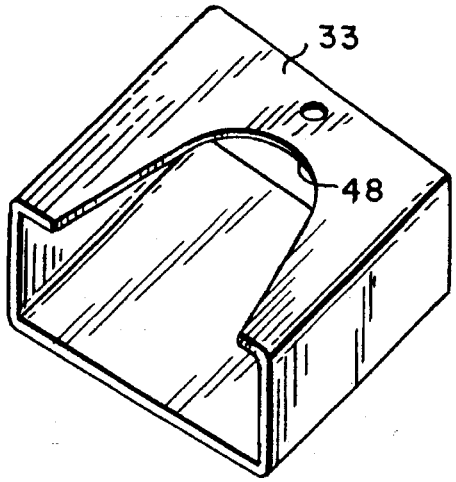
FIG. 8 illustrates a modification of the cartridge employed in the system of FIG. 1.

To facilitate the grasping of a bag by a user for removal from the pack, the top panel 33 of the cartridge 13 may be provided with an arcuate cutout 48 as illustrated in FIG. 8. This cutout may be provided in the initial manufacture of the cartridge or perforations may be provided so that the user can remove the cutout section.

Figure 9:
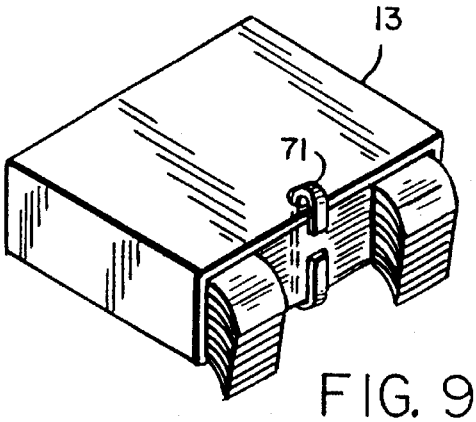
FIG. 9 illustrates a method of attaching bags to a cartridge.
Figure 10:
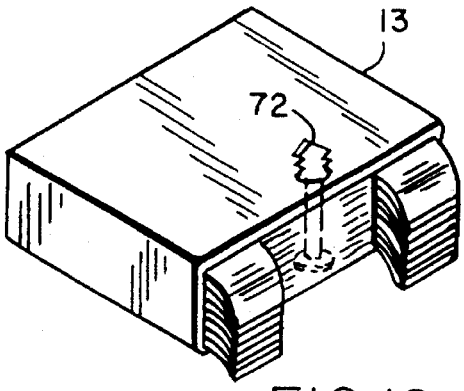
FIGS. 10 and 11 illustrate alternate methods of attaching bags to a cartridge.
Figure 11:
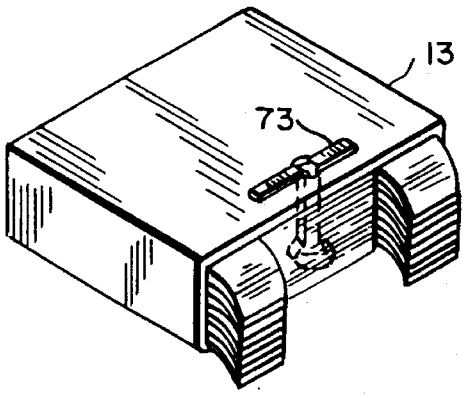
Figure 12:
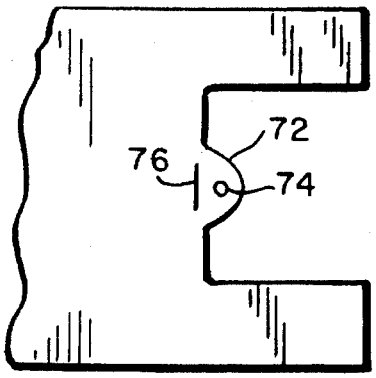
FIG. 12 illustrates an alternate bag design providing a detachable tab employed for attaching the bags to a cartridge.
Figure 13:
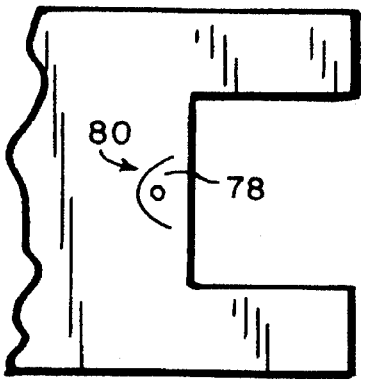
FIGS. 13 and 14 illustrate another alternate bag design.
Figure 14:
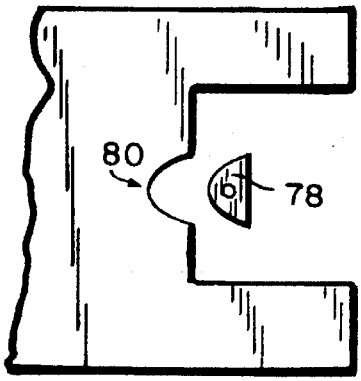

The center portions of the bag mouths are releasably attached to an adjacent portion of the cartridge by any one of several expedients. FIG. 9 illustrates the use of a bent wire 71 which passes through the apertures 28. FIG. 10 illustrates a so-called ratchet fastener 72 and FIG. 11 illustrates a cotter pin like fastening 73. While these fasteners are intended to allow the fasteners to rip out of the aperture 28, it would also be conventional and within the scope of the present invention to provide a tab which breaks away from the bag mouth as illustrated in FIGS. 12–14. In FIG. 12, a tab 72 projects from the bag mouth, incorporates an aperture 74 for the fastener and includes a slit 76 cut across a majority of the width of the tab so as to provide easily severable portions on each side. In the embodiment illustrated in FIGS. 12 and 13, the attaching aperture 78 is within the face panel of the bag but an arcuate cut 80 is provided so that that portion can be torn away by breaking the easily severed portions on either side of the arcuate cut. Further, an alternative would be to provide a small glued point attaching each of the successive bag panels to each other and to the adjacent portion of the cartridge, or, if the materials are compatible, a hot pin weld joining all of the bag panels to the adjacent portion of the cartridge.

To obtain a bag for use, a user merely grasps the top bag in the pack as it bends over the proximal end of the cartridge and pulls that bag through the cartridge breaking the releasable attachment at the mouth of the bag. Since the handles 23 and 25 and the bottom of the body of the bag hang freely downwardly, the cartridge 13 and rack 15 need be only as deep as the top portion of the body of the bags, and thus, a relatively short distance is required underneath the merchandiser's checkout counter.

Figure 15:
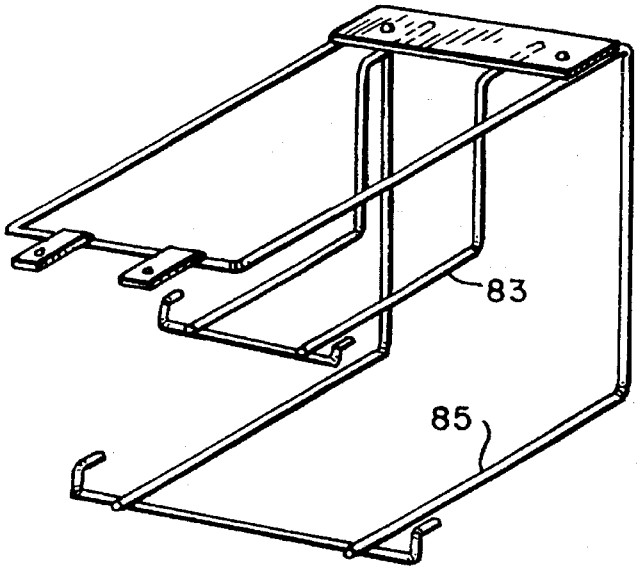
FIG. 15 illustrates a rack adapted to hold bag packs of two different sizes.
Figure 16:
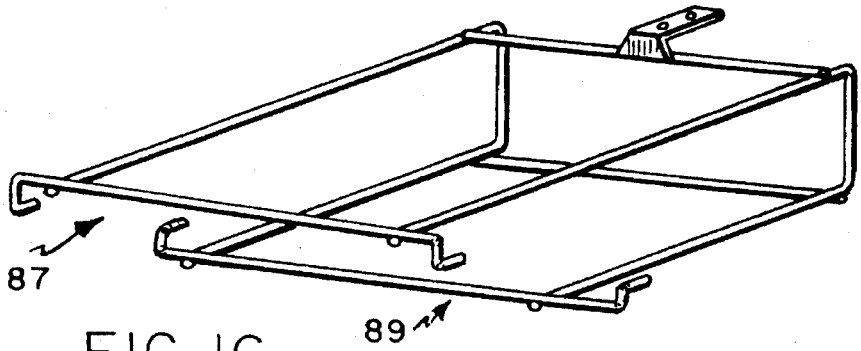
FIG. 16 illustrates a reversible rack.

As will be apparent, the bags dispensed in this manner can be of different sizes and FIG. 15 illustrates a rack having two different sized hooked arms 83 and 85 adapted to hold larger and smaller cartridges of the same general type as illustrated heretofore. FIG. 16 illustrates a rack which is reversible and, depending on the installation needs, it can be flipped over since there are hooks 87 and 89 on either side capable of retaining the bag holding cartridge.

Figure 17:
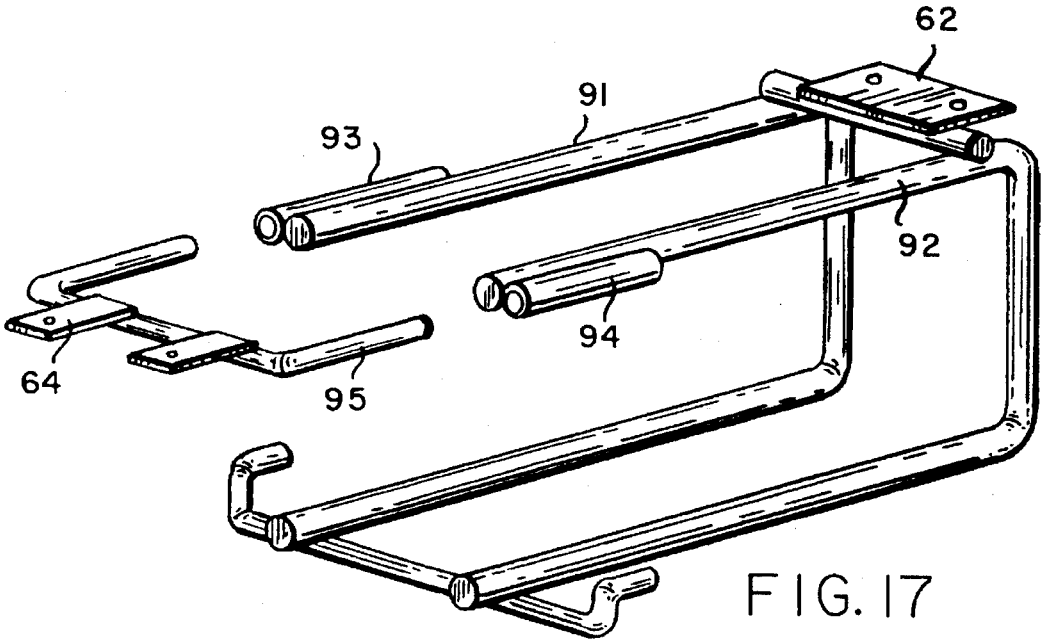
FIG. 17 illustrates a rack of adjustable depth.

In some situations, e.g., when used under a shallow counter, it may be useful to employ a rack of adjustable depth. Such a rack is illustrated in FIG. 17. In the construction illustrated, the rods 91 and 92, which form the cartridge holding parts, are provided on their upper portions with tubes 93 and 94 which can receive the ends of a U-shaped bar 95 which bridges them and completes the assembly for mounting under a counter. The extent to which the ends of the U-shaped bar 95 are inserted in the tube then defines the operative depth.

In view of the foregoing it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A dispensing system for T-shirt bags comprising:

an aligned stack of T-shirt type bags each of which includes front and back panels joined at the sides and bottom with an openable bag mouth at the top and with loop handles extending from both sides of the mouth;

surrounding the upper portions only of the aligned front and back bag panels, a tubular cartridge having top and bottom panels joined by side panels, the loop handles and a significant portion of the bottoms of said bags extending beyond the open ends of said tubular cartridge; and a rack for supporting said cartridge with said top and bottom panels essentially horizontal and with said handles and the bottom portions of said bags hanging freely from said cartridge.

2. A dispensing system as set forth in claim 1 wherein said rack includes a horizontal arm which is slightly less wide than the space between bag loop handles, which underlies and supports said cartridge, and which terminates in a hook portion for retaining said cartridge as individual bags are withdrawn by a user by being pulled through said cartridge.

3. A dispensing system as set forth in claim 1 further comprising means for releasably attaching the central portions of the bag mouth to an adjacent portion of said cartridge.

4. A dispensing system as set forth in claim 1 wherein said front and back panels include an aperture near the central portion of the mouth of the bag and wherein a pin-like member passes through said apertures and releasably attaches the mouths of the bags to an adjacent portion of said cartridge.

5. A dispenser pack of T-shirt bags comprising:

an aligned stack of T-shirt type bags each of which includes front and back panels joined at the sides and bottom with an openable bag mouth at the top and with loop handles extending upwardly from both sides of the mouth;

surrounding the upper portions only of the aligned front and back bag panels, a disposable tubular cartridge of rectangular cross-section having top and bottom panels joined by side panels, the loop handles and a significant portion of the bottoms of said bags extending beyond respective open ends of said tubular cartridge; and means for releasably attaching the central portions of the bag mouths to an adjacent portion of said cartridge.

6. A dispenser pack as set forth in claim 5 wherein cartridge is constructed of cardboard.

7. A dispenser pack as set forth in claim 5 wherein said attaching means comprises a pin-like member passing through aligned apertures in said bags and said cartridge.

8. A dispenser pack as set forth in claim 5 wherein the bottom panel of said cartridge is slit substantially in alignment with the edges of said handles thereby defining portions which can be deflected downwardly by said handles.

9. A dispenser pack as set forth in claim 5 wherein the bottom panels of said cartridge is beveled in alignment with said handles thereby permitting said handles to hang on a bias.

10. A dispensing system for T-shirt bags comprising:

an aligned stack of T-shirt type bags each of which includes front and back panels joined at the sides and bottom with an openable bag mouth at the top and with loop handles extending upwardly from both sides of the mouth;

surrounding the upper portions only of the aligned front and back bag panels, a disposable tubular cartridge of rectangular cross-section having top and bottom panels joined by side panels, the loop handles and a significant portion of the bottoms of said bags extending beyond respective open ends of said tubular cartridge;

means for releasably attaching the central portions of the bag mouths to an adjacent portion of said cartridge; and an under counter rack for supporting said cartridge with said top and bottom panels essentially horizontal and with said handles and the bottom portions of said bags hanging freely from said cartridge.

11. A dispensing system as set forth in claim 10 wherein said rack includes a horizontal arm which is slightly less wide than the space between bag loop handles, which underlies and supports said cartridge, and which terminates in a hook portion for retaining said cartridge as individual bags are withdrawn by a user by being pulled through said cartridge.

12. A dispensing system as set forth in claim 10 wherein said front and back panels include an aperture near the central portion of the mouth of the bag and wherein a pin-like member passes through said apertures and releasably attaches the mouths of the bags to an adjacent portion of said cartridge.

* * * * *